US005635051A

United States Patent [19]

Salas-Morales et al.

[11] Patent Number: 5,635,051

[45] Date of Patent: Jun. 3, 1997

[54] INTENSE YET ENERGY-EFFICIENT PROCESS FOR ELECTROWINNING OF ZINC IN MOBILE PARTICLE BEDS

[75] Inventors: Juan C. Salas-Morales, Chuquicamata, Chile; Stanley C. Siu, Alameda; James W. Evans, Piedmont, both of Calif.; Oliver M. G. Newman, Woodville, Australia

[73] Assignee: The Regents of the University of California, Oakland, Calif.

[21] Appl. No.: 521,021

[22] Filed: Aug. 30, 1995

[51] Int. Cl.[6] ..... C25D 3/22

[52] U.S. Cl. ..... 205/602; 205/560; 205/603

[58] Field of Search ..... 205/560, 602, 205/603

[56] References Cited

U.S. PATENT DOCUMENTS

| | | | |
|---|---|---|---|
| 3,663,298 | 5/1972 | McCoy et al. . | |
| 3,755,114 | 8/1973 | Tarjanyl et al. . | |
| 3,766,024 | 10/1973 | Yamagishi et al. | 204/55 R |
| 3,767,466 | 10/1973 | McCoy et al. . | |
| 3,974,049 | 8/1976 | James et al. | 204/106 |
| 4,019,968 | 4/1977 | Spazlante et al. . | |
| 4,039,402 | 8/1977 | LeRoy . | |
| 4,088,556 | 5/1978 | Pellegri et al. . | |
| 4,090,927 | 5/1978 | Fresnel et al. . | |
| 4,171,249 | 10/1979 | Newton et al. . | |
| 4,240,886 | 12/1980 | Hodges et al. . | |
| 4,272,333 | 6/1981 | Scott et al. . | |
| 4,278,521 | 7/1981 | Kreysa . | |
| 4,292,144 | 9/1981 | Lepetit et al. . | |
| 4,330,386 | 5/1982 | Korinek et al. . | |
| 4,345,980 | 8/1982 | Chow et al. . | |
| 4,412,894 | 11/1983 | Juda et al. | 204/119 |
| 4,557,812 | 12/1985 | Goodridge et al. . | |
| 4,626,331 | 12/1986 | Goto et al. . | |
| 4,734,172 | 3/1988 | Hedstrom et al. . | |
| 5,006,424 | 4/1991 | Evans . | |

FOREIGN PATENT DOCUMENTS 2048306 2/1980 United Kingdom .

OTHER PUBLICATIONS

J.W. Evans, "Electricity in the Production of Metals: From Aluminum to Zinc," *Metallurgical and Materials Transactions* (Apr. 1995) 26B: 189–208.

*Primary Examiner*—Kathryn L. Gorgos
*Assistant Examiner*—Alex Noguerola
*Attorney, Agent, or Firm*—Townsend and Townsend and Crew LLP

[57] ABSTRACT

Zinc metal is deposited on mobile seed particles in an electrowinning process. Exceptionally favorable results in terms of production rate, current efficiency and energy consumption are achieved by using a unique combination of design parameters and operating conditions achieved by selected ranges for particle size, current density, particle bed thickness, and acid content of the electrolyte.

20 Claims, 8 Drawing Sheets

INTENSE YET ENERGY-EFFICIENT PROCESS FOR ELECTROWINNING OF ZINC IN MOBILE PARTICLE BEDS

This invention resides in the fields of zinc electrowinning and particle bed electrolysis.

BACKGROUND OF THE INVENTION

The roast/leach/electrowin process is the most important method of zinc production, accounting for approximately 80% of all zinc produced. In the process, zinc sulfide concentrate is converted to zinc oxide by roasting, then leached in sulfuric acid to form soluble zinc sulfate which is readily separated from impurities such as arsenic, antimony, copper, cadmium, cobalt and nickel which are adsorbed by the insoluble hydrous oxides formed in the leaching stage and can be further removed by the cementation process, and finally the solution is electrolyzed in an electrolytic cell where zinc metal deposits at the cathode. Oxygen is liberated at the cell anode, regenerating sulfuric acid which is recycled to leach further zinc oxide.

Zinc reduction and hydrogen reduction are competing processes in the electrolytic cell, hydrogen reduction being thermodynamically favored over zinc reduction. Zinc reduction can be kinetically favored however due to the high overpotential for hydrogen deposition on suitable metal surfaces. This can be done by conducting the solution purification stage to remove metals that promote hydrogen reduction such as cobalt and nickel, and by ensuring that the deposited zinc is always cathodically protected to prevent it from redissolving. A further need of the process is that the spent electrolyte returned from the cells to the leach step should have as high a sulfuric acid concentration as possible to achieve a high reaction rate while minimizing the size and investment cost of the leaching equipment. Optimal performance in terms of these considerations is achieved when the spent electrolyte has a sulfuric acid:zinc mole ratio of about 2.

In processes currently used, electrolysis is performed in cells with parallel plate electrodes, with aluminum for the cathode and various alloys as the anode. For considerations of energy consumption, the most efficient operation is achieved with a current density of approximately 400 amperes per square meter ($A/m^2$) of cathode surface. In no such process does the current density ever exceed 1,000 $A/m^2$. Because of this low intensity operation and the essentially two-dimensional electrode surface configuration, economic considerations require the use of numerous large electrolytic cells and thus entail a high investment cost. Furthermore, the cathode must be periodically removed from the cell to permit detachment of the zinc deposit and cleaning of the cathode, which require the operator to disconnect the circuit. A further difficulty with the conventional process is the emission of acid mist by the cell. The mist is an environmental hazard and difficult to contain.

A variation on this process that overcomes some of these difficulties is the use of an electrolytic cell with a particle bed electrode, i.e., a bed of particles in either intermittent or continuous contact with a current feeder, which is an electrified surface similar to one of the electrodes in a conventional cell, supplying the charge to the particles. Deposition of zinc takes place at the surfaces of the particles, which offer a much greater surface area per unit volume of cell than a simple plate cathode. Current density in a particle bed cell can be significantly decreased due to the greater effective surface area. This allows the process to be operated more intensely, with a higher interfacial current density between anode and cathode. Furthermore, the particles can be periodically or continuously withdrawn, thereby eliminating the need to remove the plate cathode and strip zinc deposit from its surface.

Three forms of particle bed electrodes have been disclosed—fluidized beds, stationary beds and moving packed beds. Fluidized bed electrodes suffer from the difficulty that some portion of the particles is at all times electrically isolated from the current feeder. These isolated particles tend to redissolve in the acid electrolyte, causing excessive generation of hydrogen gas at the cathode at the expense of zinc deposition. This lowers the current efficiency and energy efficiency of the cell.

In packed (stationary) bed electrodes, all particles are in constant contact with the current feeder, removing the difficulty of particle dissolution. Unfortunately, the depositing zinc causes the particles to agglomerate, making it difficult if not impossible to remove them from the cell on a continuous or intermittent basis.

Moving (or moving packed) beds are a hybrid of fluidized and stationary beds. Particle movement is maintained at a level that is high enough to prevent particle agglomeration yet low enough to keep void space to a minimum and to keep the particles predominantly in contact with the current feeder. A disclosure of moving bed electrolysis is found in Scott et al., U.S. Pat. No. 4,272,333, issued Jun. 9, 1981. Scott et al. address copper, zinc, cobalt and manganese deposition from various alkali, acidic and neutral solutions using an electrolytic cell in which particles in the solution move as a packed bed across the surface of an electrode. The patent reports high current efficiencies (the amount of current used in reduction of the metal as a percentage of the total current consumed in the cell) and low energy consumption for copper deposition, but for zinc deposition unfortunately the results are considerably less favorable. This is understandable in view of the greater reactivity of zinc and hence its greater tendency to dissolve in acid sulfate electrolytes.

SUMMARY OF THE INVENTION

It has now been discovered that by use of a unique combination of design parameters and operating conditions, a zinc electrowinning process in a mobile bed of particles can result in a high production rate (weight of zinc deposited per unit of cell volume) at high current efficiency (the amount of current consumed by the zinc deposition as a proportion of the total current consumed in the cell) and low energy consumption (the total amount of electrical energy consumed by the cell per unit weight of zinc deposited). The operating conditions which are controlled to achieve this result are the particle size and the current density, as functions of the amount of acid present in the electrolyte and the thickness of the bed of moving particles. By limiting these parameters in accordance with the invention, current efficiencies exceeding those reported by Scott et al. by 20% or more can be achieved.

The particle bed is most advantageously operated as a moving bed, in which at least a portion of the bed is similar to a packed bed with a high degree of contact between the particles and the current feeder and a low proportion of void space in the particle bed, yet with constant motion of the bed relative to the current feeder. Motion of the bed is preferably achieved by imposing a flow on the electrolyte solution in such a manner as to create a levitation region (i.e., a spout) in the cell distinct from, and preferably adjacent to, the moving packed bed. The bed is preferably a rectangular bed with a shallow bed thickness (the dimension in the direction of the current) relative to the dimensions of the bed parallel to the current feeder and counter electrode.

DETAILED DESCRIPTION OF THE INVENTION AND PREFERRED EMBODIMENTS

Figure 1A:
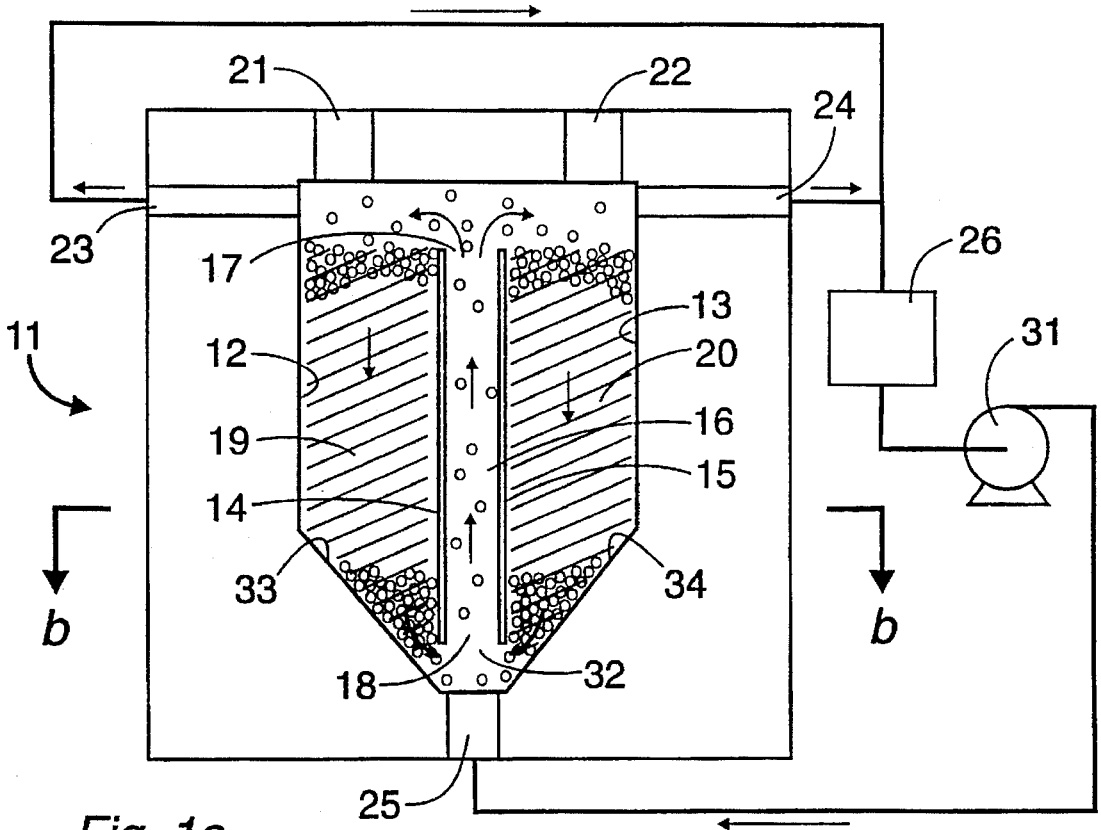
FIG. 1*a* is a side elevation in cross section of one example of an electrolytic cell for the electrowinning of zinc in accordance with this invention.

The terms used in this specification are defined as follows:

The "current feeder" is a stationary solid electrified conductor immersed in the electrolyte solution and positioned to be struck by at least a portion of the zinc particles in the moving bed so that the potential on the conductor is transmitted to the particles. The potential on the current feeder is negative, thus causing the particles charged by it to function collectively as a cathode. Alternative terminology for the current feeder may be "current collector." In the absence of the particles, the current feeder would itself serve as the cathode.

The "counter electrode" is the anode.

The "gap width" is the distance between the current feeder and the ion-permeable diaphragm separating the current feeder and the counter electrode. In cell configurations in which the current feeder and diaphragm are not parallel, the term "gap width" is used to denote the distance averaged over the surfaces of the current feeder and diaphragm. For moving packed beds of particles, the gap width is equal to the bed thickness.

The "projected surface area" of either the current feeder or the counter electrode is surface area of a projection of either of these electrified elements on a plane parallel to the element. For flat plate elements, the projected surface area of one element is equal to the area of the side of that element facing the other element. For an element with a surface in the shape of a smooth cylinder or a portion of the cylinder, the projected surface area is the actual area of the surface. For an element with a corrugated surface, the projected surface area is the area within the outline of the surface as projected onto a planar surface parallel to the central plane of the corrugated surface. For an element in the form of a planar mesh, the projected surface area is the area within the outline of the mesh as projected onto a continuous planar surface. The definition as applied to other examples will be readily apparent to those of skill in the art.

The "superficial current density" is the current passing through the cell divided by the projected surface area of the element having the largest projected surface area.

The "cell voltage" is the voltage difference between the current feeder and the counter electrode.

The "current efficiency" is the ratio, generally expressed as a percentage, of the actual zinc deposition rate to the rate which would be achieved if all of the current passing through the cell were consumed by reduction of zinc ion. The current efficiencies in zinc electrowinning cells are less than 100% because of the concurrent reduction of hydrogen ion competing with the zinc reduction at the cathode.

The "power consumption" or "energy consumption" is the amount of electrical energy consumed by the cell for each unit weight of zinc deposited. The amount of electrical energy consumed will also include electrical energy consumed by reactions competing with zinc reduction, such as hydrogen gas generation.

Operating conditions that will produce the improved results forming the basis of this invention are as follows.

For electrolytes containing acid at a concentration of $1.2\times10^{-2}$N or less and a gap width of 20 mm or less, the cell is best operated at a superficial current density (C.D.) defined by the equation:

$$C.D. \leqq 22{,}000-(800\times\text{gap width})$$

in which the C.D. is in amperes per square meter of the projected surface area of the largest of the two elements, i.e. , the current feeder and the counter electrode (hereinafter referred to as "A/m$^2$"). For electrolytes containing acid at a concentration of $1.2\times10^{-2}$N or less and a gap width greater than 20 mm, the cell is best operated at:

$$C.D. \leqq 6{,}000\ \text{A/m}^2$$

For electrolytes containing acid at a concentration of $1.2\times10^{-2}$N to 4.0N (or greater than $1.2\times10^{-2}$N and less than 4.0N) and a gap width of 20 mm or less, the cell is best operated at a superficial current density (in A/m$^2$) defined as follows:

$$80\times\text{gap width} \leqq C.D. \leqq 22{,}000-(800\times\text{gap width})$$

For electrolytes containing acid at a concentration of $1.2\times10^{-2}$N to 4.0N (or greater than $1.2\times10^{-2}$N and less than 4.0N) and a gap width greater than 20 mm, the cell is best operated at a superficial current density (in A/m$^2$) defined as follows:

$$1{,}600 \leqq C.D. \leqq 6{,}000$$

Also for best results, the particle sizes at the start of the process are within the range of 0.3 mm to 0.25×the gap width for electrolytes containing acid at a concentration of $1.2\times10^{-2}$N or less, and within the range of 0.5 mm to 0.25×the gap width for electrolytes containing acid at a concentration of $1.2\times10^{-2}$N to 4.0N.

Within these ranges, certain narrower ranges are preferred. The gap width is preferably 5 mm or greater, more preferably 5 mm to 25 mm. Still more preferably, the gap width is 10 mm or greater, and more preferably yet, 10 mm to 15 mm. For cells with a gap width of 20 mm or less, regardless of the amount of acid in the electrolyte, preferred values for the superficial current density are within the maximum defined by the equation:

$$C.D. \leqq 14{,}000-(400\times\text{gap width})$$

Regardless of the gap width, a particularly preferred range for the current density is 2,000 to 4,000 A/m$^2$. Preferred particle sizes are those in which the number mean particle diameter is within the range of 0.35 mm to 2.25 mm, and the most preferred are those in which this range is 1.0 mm to 1.5 mm. The particle size spread is not critical, although narrower spreads will provide greater control over the operating conditions and the most favorable results. In most operations, best results will be achieved when at least 95% of the particles fall within the size range extending from about one-half the number average particle size to about twice the number average particle size. All of the above particle sizes refer to the particles at any point in time during operation of the cell. In typical operation, seed particles will be added either intermittently, continuously or in batchwise manner, and larger particles removed likewise, such that the particles in the cell remain within these size ranges. While the seed particles can theoretically be any material capable of conducting electricity and serving as a cathode, for practical use of the process in the electrowinning of zinc, the seed particles will themselves be zinc as well.

In further preferred implementations of the invention, the ratio of the number mean particle diameter to the gap width is within the range of 0.035 to 0.2, and most preferably the range of 0.067 to 0.2. Cell voltages in preferred implementations of the invention are within the range of 1.0 to 5.0 volts, more preferably 2.5 to 4.0 volts, and most preferably 3.0 to 3.5 volts.

The electrolyte solution is preferably an aqueous solution, and the zinc ion in the solution can be the cation of any soluble zinc salt. Examples are zinc halides, such as chloride, bromide and iodide, zinc chlorate, zinc bromate, zinc arsenate, zinc permanganate, zinc dichromate and zinc sulfate. In view of the value of this process in recovering zinc from zinc ore after roasting the ore and leaching the roasted ore with sulfuric acid, zinc sulfate is of particular interest.

The quantity of zinc ion in the initial electrolyte solution may be varied considerably while still achieving the beneficial results of this invention. In most cases, best results are generally obtained with a zinc ion content (expressed in terms of dissolved zinc metal) ranging from 50 grams per liter of electrolyte solution (g/L) to 300 g/L, and preferably from 100 g/L to 200 g/L.

When acid is included in the electrolyte, the acid is preferably an inorganic acid, and preferably one with the same counterion as the zinc salt. Thus, for electrolyte solutions formed from zinc sulfate, sulfuric acid is the preferred acid. In preferred methods of operation, however, no acid is present in the electrolyte at the start of the process, and acid is merely permitted to accumulate as the electrolysis proceeds.

The process is generally permitted to continue in one cell or in a series of cells until the acidity rises to the point where the hydrogen generation at the cathode (the particle surfaces) causes the current efficiency to drop to a level at which the process is no longer economically favorable. Alternatively, the point of termination of the process can be established by the growth of the particles due to zinc deposition. On this basis, the process will be continued until the particles reach a size where particle motion in the moving bed begins to deviate significantly from optimal movement patterns due to the mass of individual particles or their size relative to that of the gap width, or where their size causes current efficiency to drop to an uneconomical level for any of various reasons. A still further alternative is to use the dissolved zinc content of the electrolyte as a measure for determining when to terminate the process. On this basis, the process is terminated when the quantity of zinc ion falls to a level where it significantly affects current efficiency. In many cases, particularly with specialized cell configurations, the continuity of the process can be extended by replenishment of the electrolyte with fresh zinc ion while the electrolysis is in progress, by selectively removing the relatively large particles and replacing them with fresh seed particles, again while the electrolysis is in progress, or both.

The temperature of the electrolyte may vary, but high temperatures may affect the efficiency of the process by affecting the surface quality of the deposition, the free flow of the particles, and the level of impurities which may be codeposited with the zinc. The current may cause the temperature to rise, and when this occurs to an undesirable degree, temperature control is readily achieved by cooling of the cell. In most applications, the temperature can range from 20° C. to 95° C. while still attaining the benefits of the invention. Preferred operation, however, will be at temperatures of 40° C. or lower.

Like conventional parallel plate electrowinning cells, certain additives may be included in the electrolyte solution to enhance the performance of the cell. Polarizing organic additives such as gelatin, animal glue, or gum arabic often increase current efficiency, and agents such as cresol, cresylic acid and sodium silicate can be included to maintain a foam in the cell and thereby minimize any mist produced at the electrodes. The amount of these added materials are not critical, and can vary. In most cases, they will range from 1 to 50 parts per million by weight of the electrolyte solution.

The current feeder and the counter electrode can be constructed of materials that are either typically used in the industry as cathodes and anodes, respectively, in a zinc electrowinning cell, or disclosed in the literature for such use. The current feeder can thus be aluminum, iron, steel, nickel, combinations of these materials in the form of alloys or claddings, or other materials known to be useful as cathodes. The counter electrode can thus be lead, platinum, iron, nickel, platinum-iridium, various metal oxides, combinations of these materials, or other materials known to be useful as anodes. Of particular interest are dimensionally stable anodes such as titanium clad with rare metal oxides such as ruthenium and titanium oxides.

Cells used in accordance with this invention will preferably include a diaphragm, membrane, or other ion-permeable barrier positioned between the current feeder and the counter electrode, either to separate the cell into anolyte and catholyte compartments and retain the particles in the catholyte compartment, or to shield the counter electrode from the particles. The barrier is preferably a neutral, non-ionized barrier, rather than a barrier such as an ion exchange membrane, and the barrier is preferably adjacent mounted to the counter electrode surface, shielding the electrode surface from the particles. Any chemically and electrically inert barrier materials may be used. Examples are porous plastic such as polytetrafluoroethylene, polyethylene, polypropylene, polycarbonate, cellulose and nylons. Membranes of these materials are commercially available under the trade names CELGUARD®(Hoechst Celanese Corp., Charlotte, N.C., USA), MILLIPORE® (Gelman Sciences, Ann Arbor, Mich., USA), GORE-TEX® (W. L. Gore & Associates, Inc., Elkton, Md., USA), and NUCLEPORE®(Costar Scientific Corp., Pleasanton, Calif., USA).

The preferred configuration of the electrowinning cell is that of a flat spouted bed cell. In cells of this type, the moving bed is confined between a vertical flat plate current feeder and a vertical flat plate anode which form an enclosure with its short dimension (the gap width) substantially smaller than both the width and height of the enclosure. A diaphragm covers the anode to shield it from the particles. During the operation of the cell, the majority of the particles in the cell are almost as densely packed as a stationary packed bed, and are moving downward under the influence of gravity. The particles are recycled to the top of the bed in a discrete levitation zone either outside or inside the cell by an upward stream of electrolyte solution pumped at a controlled rate. The levitation zone is preferably set off from the remainder of the cell volume by baffles or separating walls forming a draft tube.

Figure 1B:
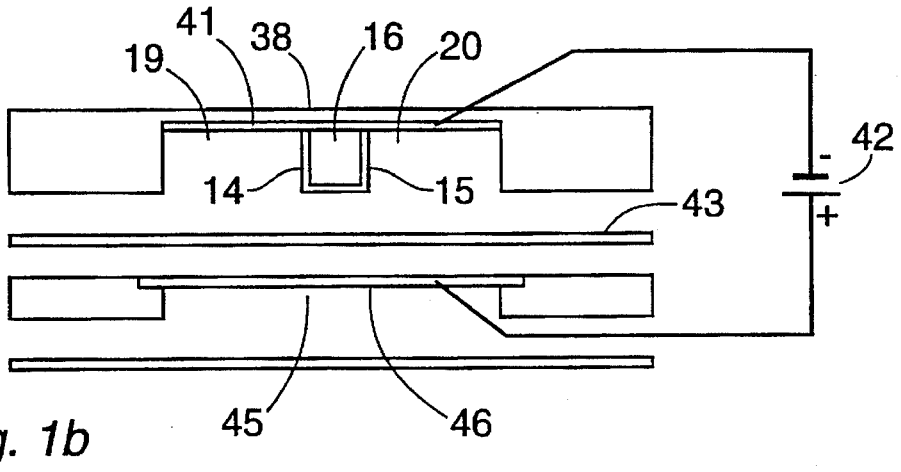
FIG. 1*b* is a cross section of the cell of FIG. 1*a*, taken along the line "b—b".

An illustration of a simplified cell of this type appears in FIGS. 1*a* and 1*b*. The side elevation of FIG. 1*a* shows the interior of the cell 11 in cross section and the flow mechanics of the cell. The cell volume occupied by the electrolyte solution and particles is defined by side edge walls 12, 13 tapering toward the bottom, and contains internal partitions 14, 15 which divide the interior into a levitation zone or draft tube 16 open at both its upper end 17 and its lower end 18, and two downflow sections 19, 20. The cell contains openings 21, 22 at the top for adding seed particles, openings 23, 24 at the upper ends of the side edge walls to serve as catholyte outlets and an opening at the base 25 to serve as a catholyte inlet. A reservoir 26 holds excess catholyte, and an external catholyte pump 31 draws the catholyte from the reservoir 26 and directs it to the catholyte inlet 25.

The catholyte inlet 25 is aligned with the draft tube 16 such that incoming catholyte flows upward inside the draft tube, drawing with it any particles located in the region 32 at the base of the cell between the draft tube entry 18 and the catholyte inlet 25, as indicated by the upward arrow shown inside the draft tube. This is the "spout" of the spouted bed terminology. As the particles reach the top of the draft tube, they disperse laterally, falling into the downflow sections 19, 20, which are occupied by particles downwardly drifting in a more dense arrangement, i.e., a moving packed bed (represented by the parallel diagonal lines). The sloping lower ends 33, 34 of the side edge walls help maintain the packing density of the moving bed and prevent the occurrence of dead spaces in the particle and electrolyte flow. The flow rate or force of the catholyte spout or jet entering the draft tube determines how well the particles leaving the top of the tube will be dispersed over the top of the moving packed beds in the downflow sections 19, 20. The jet force also determines the particle packing density in the moving packed beds. In addition, the jet force can determine the proportion of catholyte being drawn off by the pump 31 relative to the total catholyte circulating through the draft tube 16, and hence the flow rate of the liquid electrolyte solution in the downflow sections, where the electrolyte will generally be flowing downward with the particles as indicated by the arrows shown in these sections.

The electrical characteristics of the cell are shown in the cross section of FIG. 1*b* which is exploded front-to-back. The back wall 38 of the cell is coated or laminated with a surface layer 41 of a conductor extending across both the draft tube 16 and the downflow sections 19, 20. This conductor layer is connected to the negative pole of a power source 42 and thereby serves as the current feeder to the particles in the cell. A diaphragm 43 divides the cell into a catholyte compartment (which consists of the draft tube 16 and the downflow sections 19, 20 combined) and an anolyte compartment 45. An anode plate 46 in the anolyte compartment is connected to the positive pole of the power source 42. The particles are retained in the catholyte compartment.

The "gap width" referred to elsewhere in this specification is represented in the cell of FIGS. 1*a* and 1*b* by the distance between the current feeder 41 and the diaphragm 43. The "projected surface area" of the current feeder 41 and that of the anode 46 are essentially equal, and this area is the area outlined by the side edge walls 12, 13, 33 and 34 of the catholyte and anolyte compartments.

Figure 2:
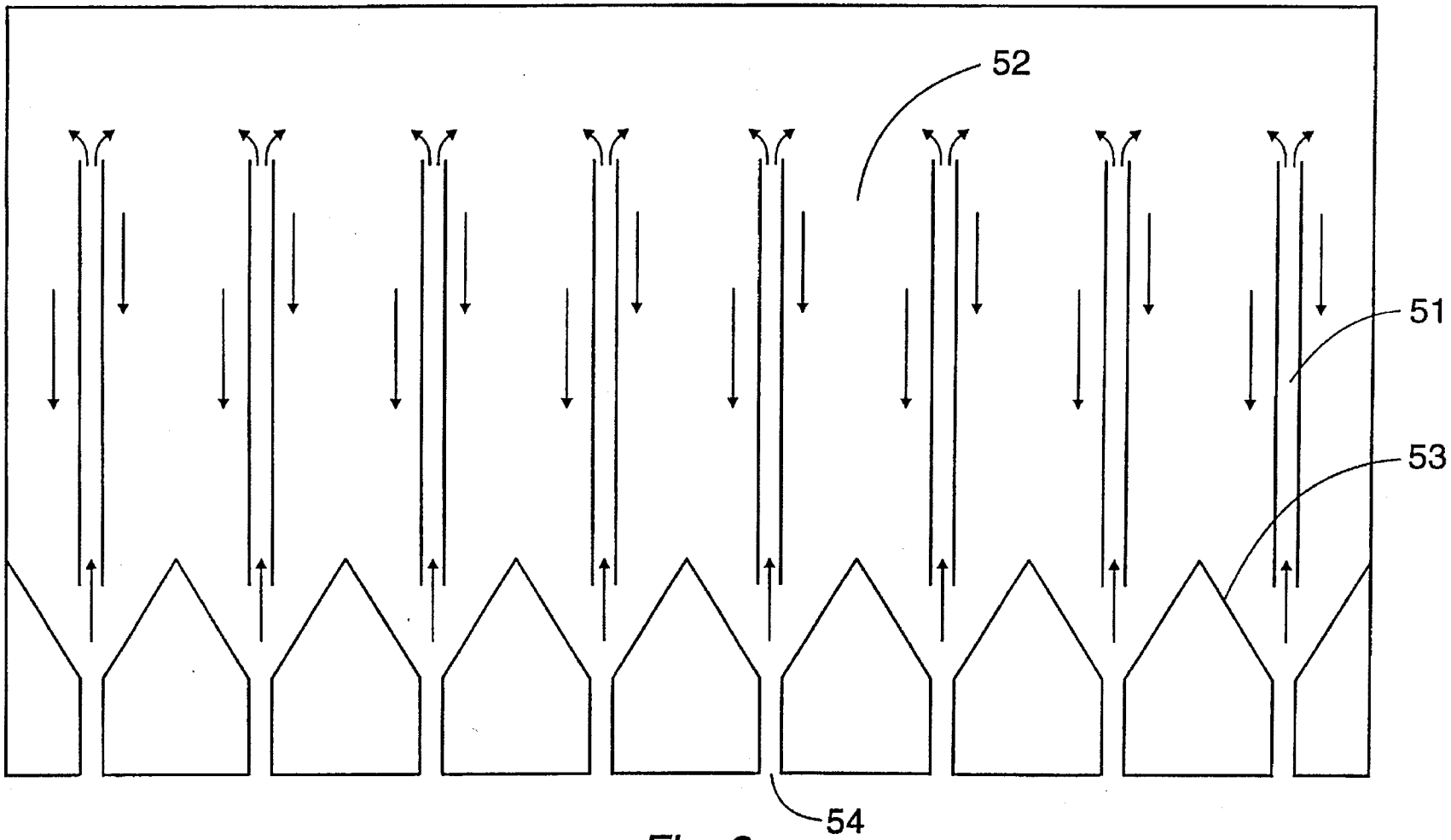
FIG. 2 is a side elevation in cross section of a second example of an electrolytic cell for use in the practice of the present invention.

A larger scale version of the flat spouted bed cell of FIGS. 1*a* and 1*b* is illustrated in FIG. 2, which is a side elevation cross section in the same view as that of FIG. 1*a*. Capacity in this cell is increased by increasing two dimensions, the horizontal dimension parallel to the current feeder and anode, and the cell height. This cell contains eight draft tubes 51, adjacent pairs of the tubes separated by downflow sections 52. The base of the cell chamber is formed from sloping wall sections 53 with catholyte inlets 54 at the junctures of their lower ends directly below the draft tubes 51. While the pump and power source used in conjunction with this cell are not shown in the drawing, they and the connections joining them to the cell are analogous to those shown in the cell of FIGS. 1*a* and 1*b*. The gap width is the same as that of the cell of FIGS. 1*a* and 1*b*, but the projected surface area and hence the current density are multiples of those of FIGS. 1*a* and 1*b*.

The following examples are offered for purposes of illustration only.

In the experiments reported in these examples, a cell having the configuration shown in FIGS. 1*a* and 1*b* was used. The gap width was varied between 1.1 and 2.2 cm; the height of the parallel vertical side edges 12, 13 (referring to FIG. 1) to the top of the draft tube 16 was 8.2 cm; the height of the lower sloping edges 33, 34 (vertical component) was 7.8 cm; the vertical distance between the upper end 17 of the draft tube and the roof of the chamber was 5.9 cm; the distance between the vertical side edges 12, 13 at the top was 9.5 cm; the width of the draft tube 16 measured from its external surfaces was 1.5 cm; and the gap 32 between the lower end 18 of the draft tube and the catholyte inlet 25 was 2 cm. The current feeder was an aluminum layer; the anode was a DSA anode ("dimensionally stable anode" consisting of titanium coated with $RuO_2$ and $TiO_2$, available from Eltech Systems Corporation, Chardon, Ohio, USA), the diaphragm was a porous polypropylene diaphragm (DARAMIC®, available from W. R. Grace & Co., Lexington, Mass.). The pump flow rate of catholyte was 1.4 gallons per minute.

EXAMPLE 1

A series of runs was conducted to determine the effect of the bed thickness (gap width) on current efficiency. Bed thicknesses of 1.1 cm and 2.2 cm were used, and the cell was charged with 425 g of zinc granules when the bed thickness was 1.1 cm, and 950 g of zinc granules when the bed thickness was 2.2 cm. The number average diameter of the particles in all runs in this series was 1.45 mm. The cell was filled with an aqueous solution of zinc sulfate at a concentration of 150 grams of dissolved zinc per liter, sufficient to completely fill the cell. The cell was run at a current density of 4,000 A/m$^2$, and bed thicknesses of 1.1 cm and 2.2 cm were used. As the run progressed, the catholyte was analyzed for acid:zinc weight ratio, with the acid expressed as sulfuric acid and the zinc as zinc sulfate, and current efficiencies were determined by two methods—(1) measuring the volume of hydrogen evolved from the cathode combined with the knowledge of the current passed through the cell, and (2) weighing the zinc both before and after the experiment. The results obtained from both types of measurements were in substantial agreement.

Figure 3:
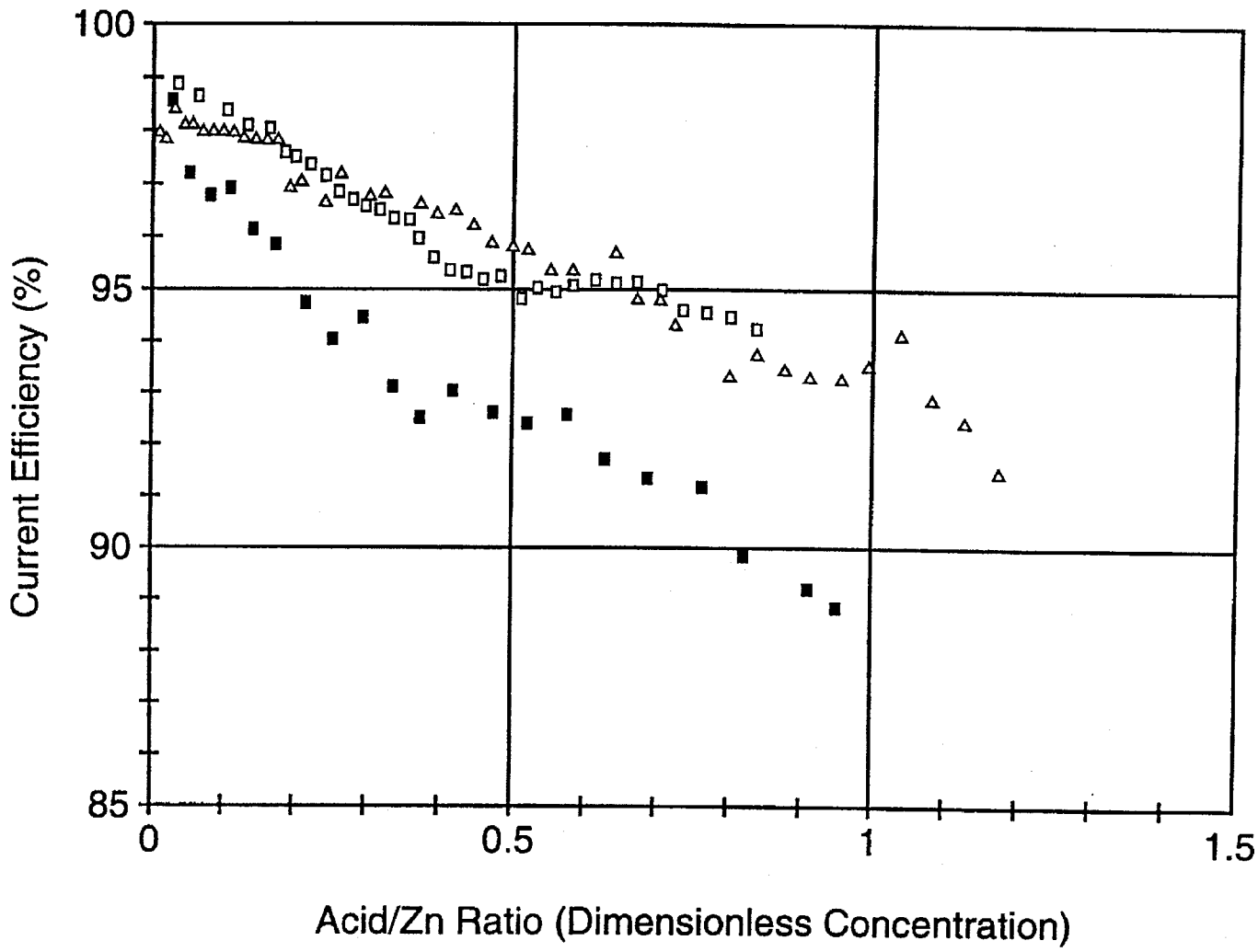
FIG. 3 is a plot of current efficiency vs. acid/zinc ratio for different bed thicknesses in accordance with the invention.

Plots of current efficiency vs. acid/zinc ratio are shown in FIG. 3, where the open squares represent one run at a bed thickness of 1.1 cm, the open triangles represent a second run at the same bed thickness to check reproducibility, and the filled squares represent a run at a bed thickness of 2.2 cm. Reproducibility of the experiment is clearly established by the closeness of the open squares and triangles, and the results indicate that greater current efficiency with the same current density and all other variables held constant is achieved with the lower bed thickness.

EXAMPLE 2

A series of runs was conducted to determine the effect of particle size on current efficiency. Cut wire of differing diameter was used as the seed particles (the lengths of the cut wire cylinders were approximately equal to the cylinder diameter) with initial charges of 425 g of the cut wire for beds 1.1 cm in thickness and 950 g for beds 2.2 cm in thickness. The zinc sulfate concentration, acid concentration and bed thickness varied, and the cell was run at a current density of 4000 A/m$^2$. Measurements of acid/zinc ratio and current efficiency were taken in the same manner as described in Example 1.

The results are plotted in FIG. 4 with the legend shown in Table I below:

TABLE I

Figure 4:
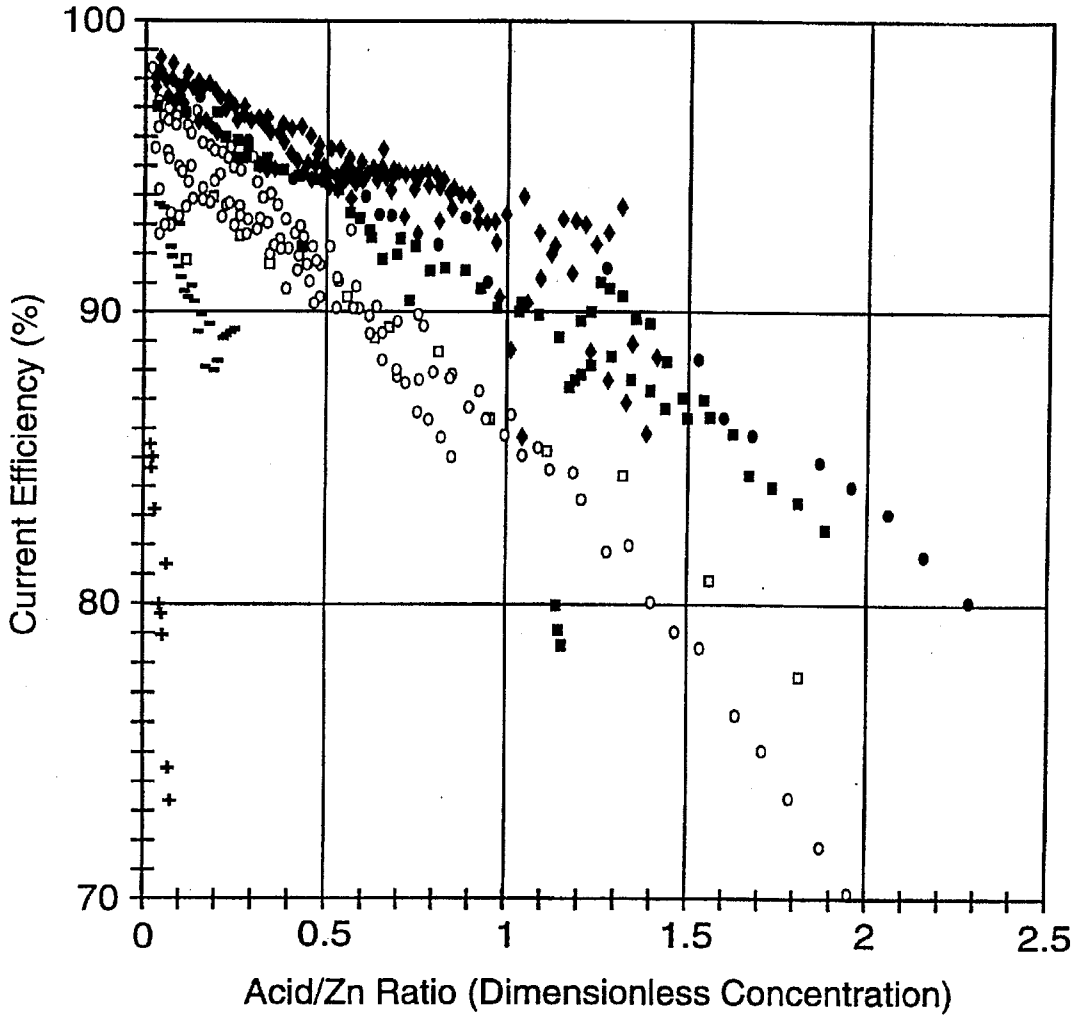
FIG. 4 is a plot of current efficiency vs. acid/zinc ratio for different particle sizes in accordance with the invention.

Legend for FIG. 4

| Symbol | Starting Catholyte $Zn^{++}$ (g/L) | Starting Catholyte $H_2SO_4$ (g/L) | Bed Thickness (cm) | Cut Wire Diameter (mm) |
|---|---|---|---|---|
| filled squares | 70 | 0 | 1.1 | 1.45 (Zn) |
| filled squares | 70 | 40 | 1.1 | 1.45 (Zn) |
| filled squares | 70 | 80 | 1.1 | 1.45 (Zn) |
| filled diamonds | 150 | 0 | 1.1 | 1.45 (Zn) |
| filled diamonds | 150 | 0 | 1.1 | 1.45 (Zn) |
| filled diamonds | 150 | 80 | 1.1 | 1.45 (Zn) |
| filled circles | 80 | 0 | 2.2 | 1.45 (Zn) |
| open squares | 67 | 0 | 2.2 | 0.76 (Zn) |
| open diamonds | 150 | 0 | 1.1 | 0.76 (Zn) |
| open diamonds | 150 | 0 | 2.2 | 0.76 (Zn) |
| open diamonds | 72 | 0 | 2.2 | 0.76 (Zn) |
| open circles | 150 | 0 | 2.2 | 0.76 (Zn) |
| minus signs | 150 | 0 | 1.1 | 0.50 (Cu) |
| plus signs | 150 | 0 | 1.1 | 0.38 (Zn) |

The results indicate that the larger diameter wire gave the greater current efficiency.

EXAMPLE 3

This series of runs was conducted to determine the effect of bed thickness on energy consumption.

Plots of energy consumption (in kilowatt-hours per kilogram of zinc deposited) vs. acid/zinc ratio were obtained in the same manner as described in Example 1, except that energy consumption (E.C.) was determined by the equation $$E.C. = \frac{V \times i \times t}{m \times 1{,}000}$$

where: V=cell voltage
i=current (amperes)
t=time of electrolysis (hours)
m=weight of zinc deposited (kilograms)

Figure 5:
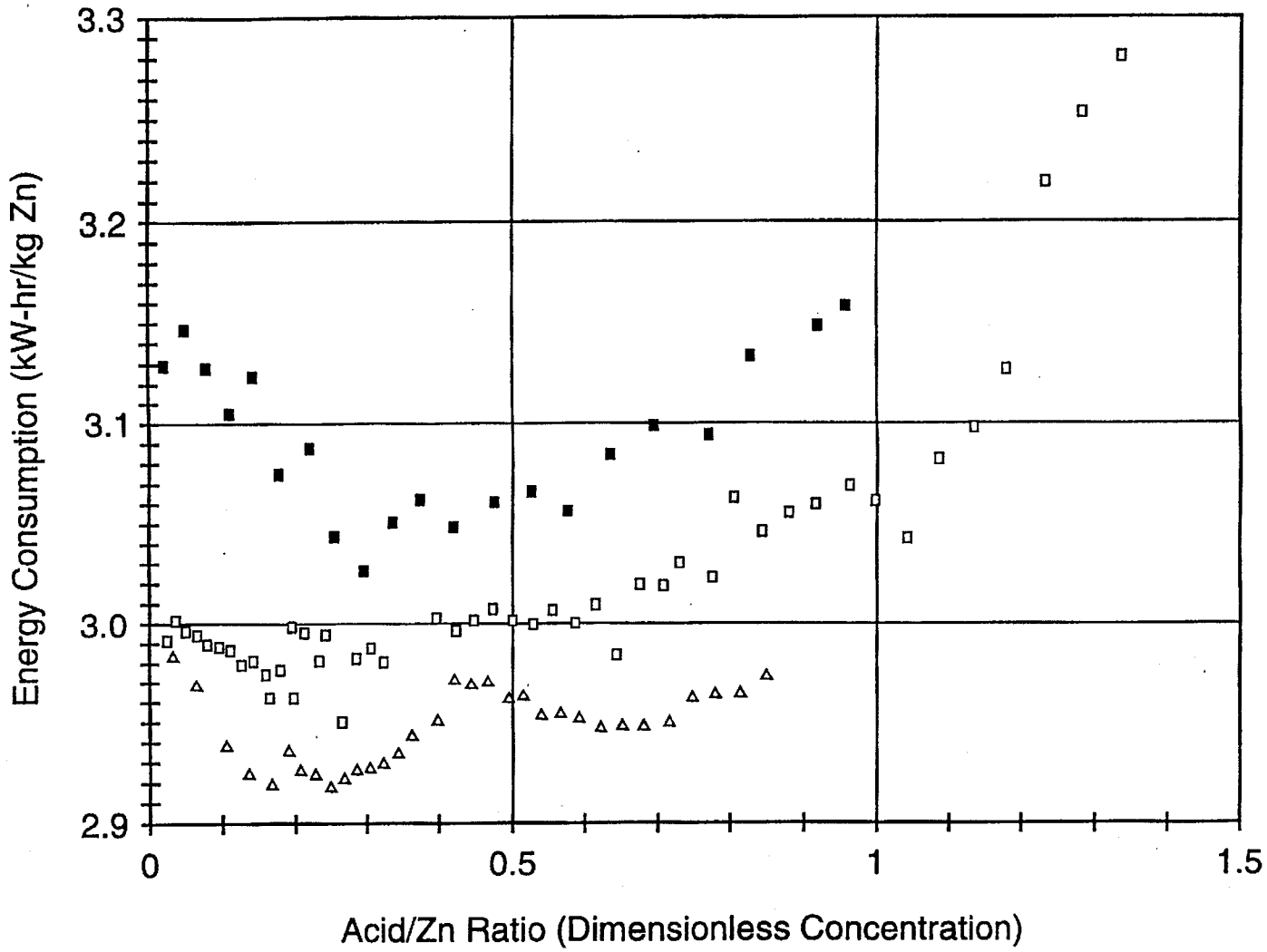
FIG. 5 is a plot of energy consumption vs. acid/zinc ratio for different bed thicknesses in accordance with the invention.

The results are shown in FIG. 5. All three runs were performed with zinc sulfate at a zinc ion concentration of 150 g/L and no acid in the starting catholyte. The seed particles were cut zinc wire with a diameter of 1.45 mm (the lengths of the cut wire cylinders were approximately equal to the cylinder diameter), the current density was 4,000 A/m$^2$, bed thicknesses of 1.1 cm and 2.2 cm were used, and the zinc particle charge was 425 g and 950 g for the two bed thicknesses, respectively. The filled squares represent a run at a bed thickness of 2.2 cm, the open squares represent a first run at a bed thickness of 1.1 cm, and the open triangles a second run at 1.1 cm bed thickness. The results show that energy consumption is lower, i.e. , the energy consumed by the cell for a given weight of zinc deposited is less, with the thinner bed.

EXAMPLE 4

This series of runs was conducted to determine the effect of particle size on energy consumption, using the same methods described in Example 3, with cut wire as the particles. The results are shown in FIG. 6 with the legend shown in Table II below:

TABLE II

Figure 6:
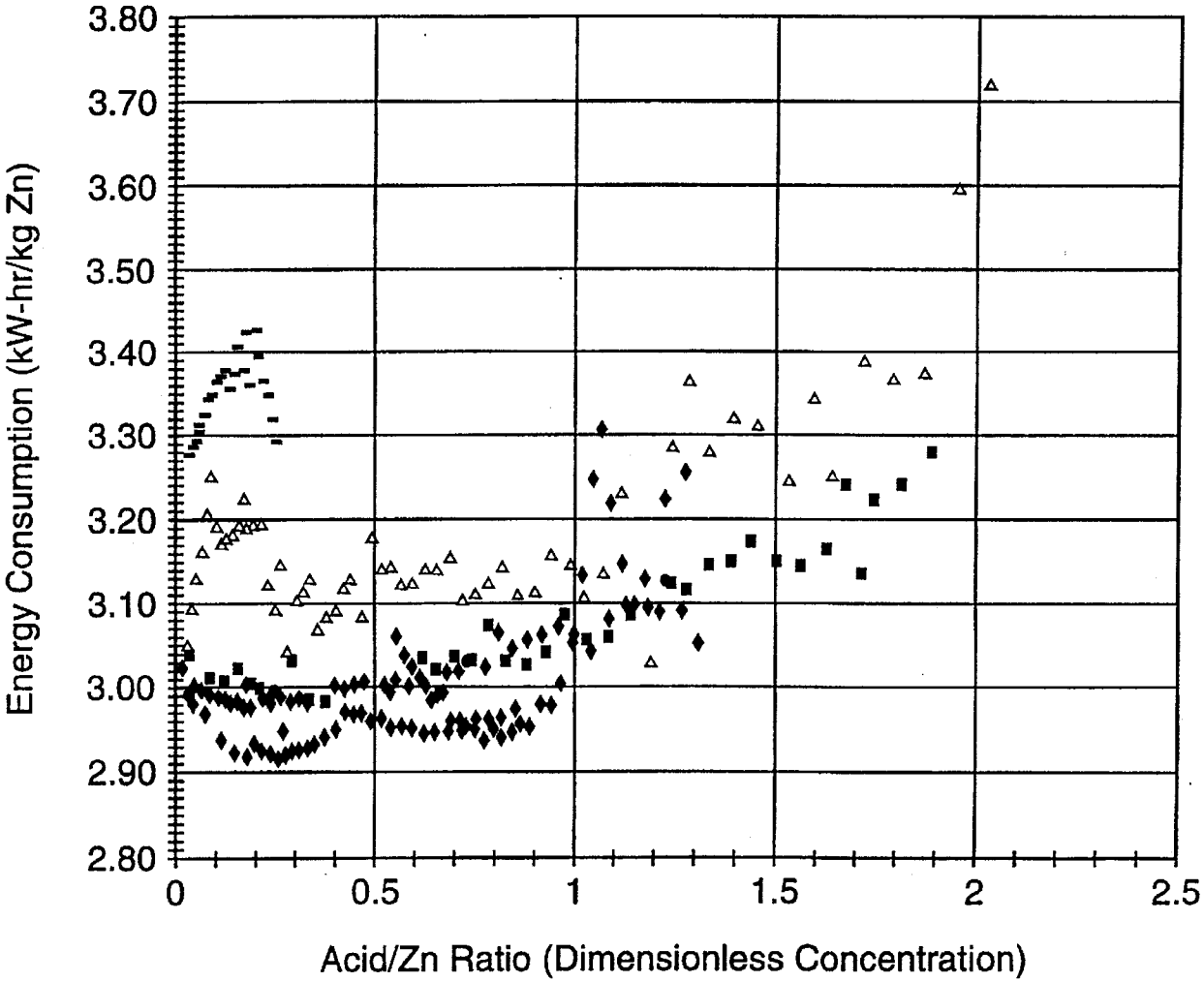
FIG. 6 is a plot of energy consumption vs. acid/zinc ratio for different particle sizes in accordance with the invention.

Legend for FIG. 6

| Symbol | Starting Catholyte $Zn^{++}$ (g/L) | Starting Catholyte $H_2SO_4$ (g/L) | Bed Thickness (cm) | Cut Wire Diameter (mm) |
|---|---|---|---|---|
| filled squares | 70 | 0 | 1.1 | 1.45 (Zn) |
| filled squares | 70 | 40 | 1.1 | 1.45 (Zn) |
| filled squares | 70 | 80 | 1.1 | 1.45 (Zn) |
| filled diamonds | 150 | 0 | 1.1 | 1.45 (Zn) |
| filled diamonds | 150 | 0 | 1.1 | 1.45 (Zn) |
| filled diamonds | 150 | 80 | 1.1 | 1.45 (Zn) |
| open triangles | 150 | 0 | 1.1 | 0.76 (Zn) |
| minus signs | 150 | 0 | 1.1 | 0.50 (Cu) |
| plus signs | 150 | 0 | 1.1 | 0.38 (Zn) |

The results show that energy consumption is lower, i.e., the energy consumed by the cell for a given weight of zinc deposited is less, with the larger particles.

EXAMPLE 5

Figure 7:
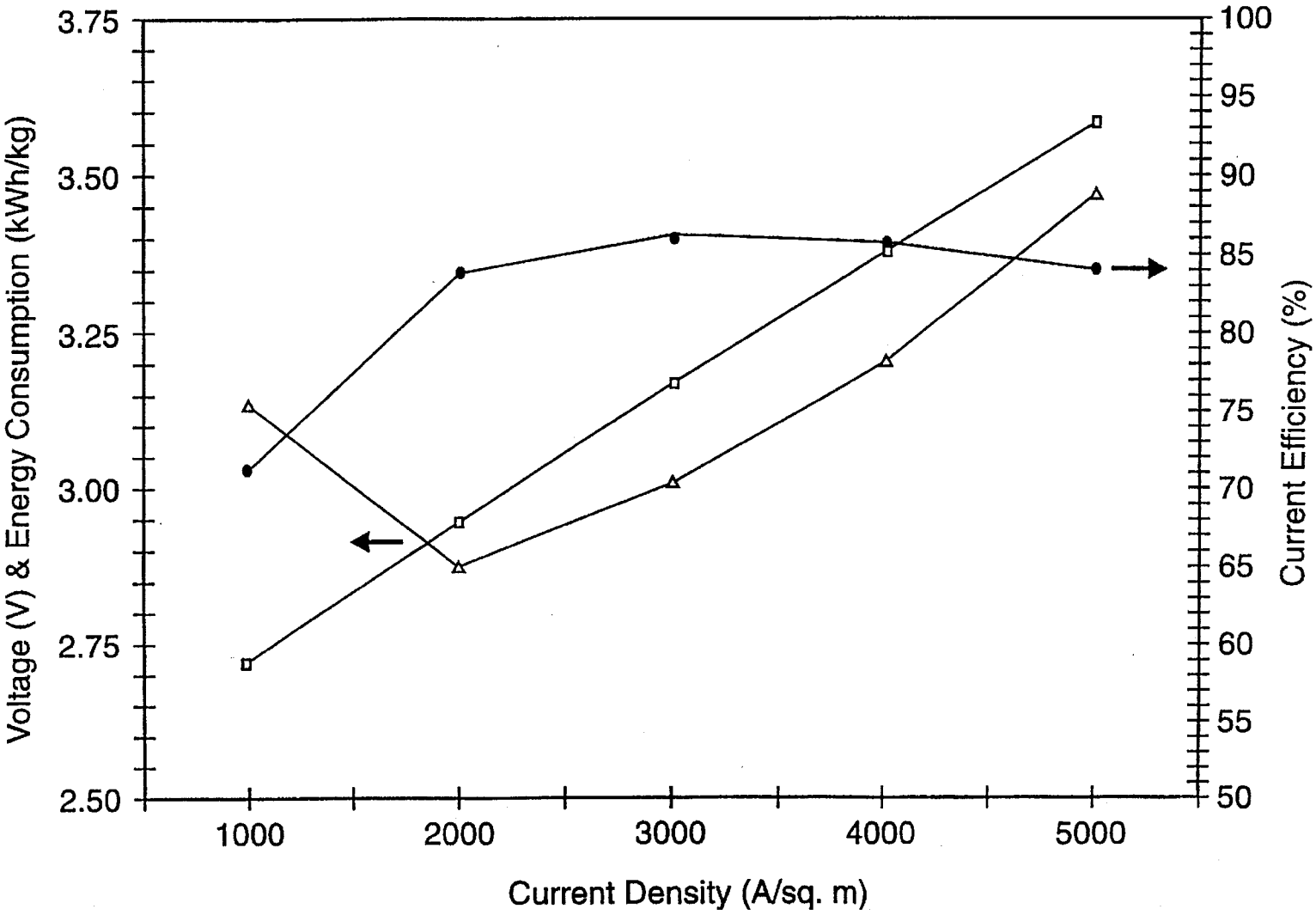
FIG. 7 is a plot of voltage, energy consumption and current efficiency vs. current density at the beginning of a run conducted in accordance with the present invention.
Figure 8:
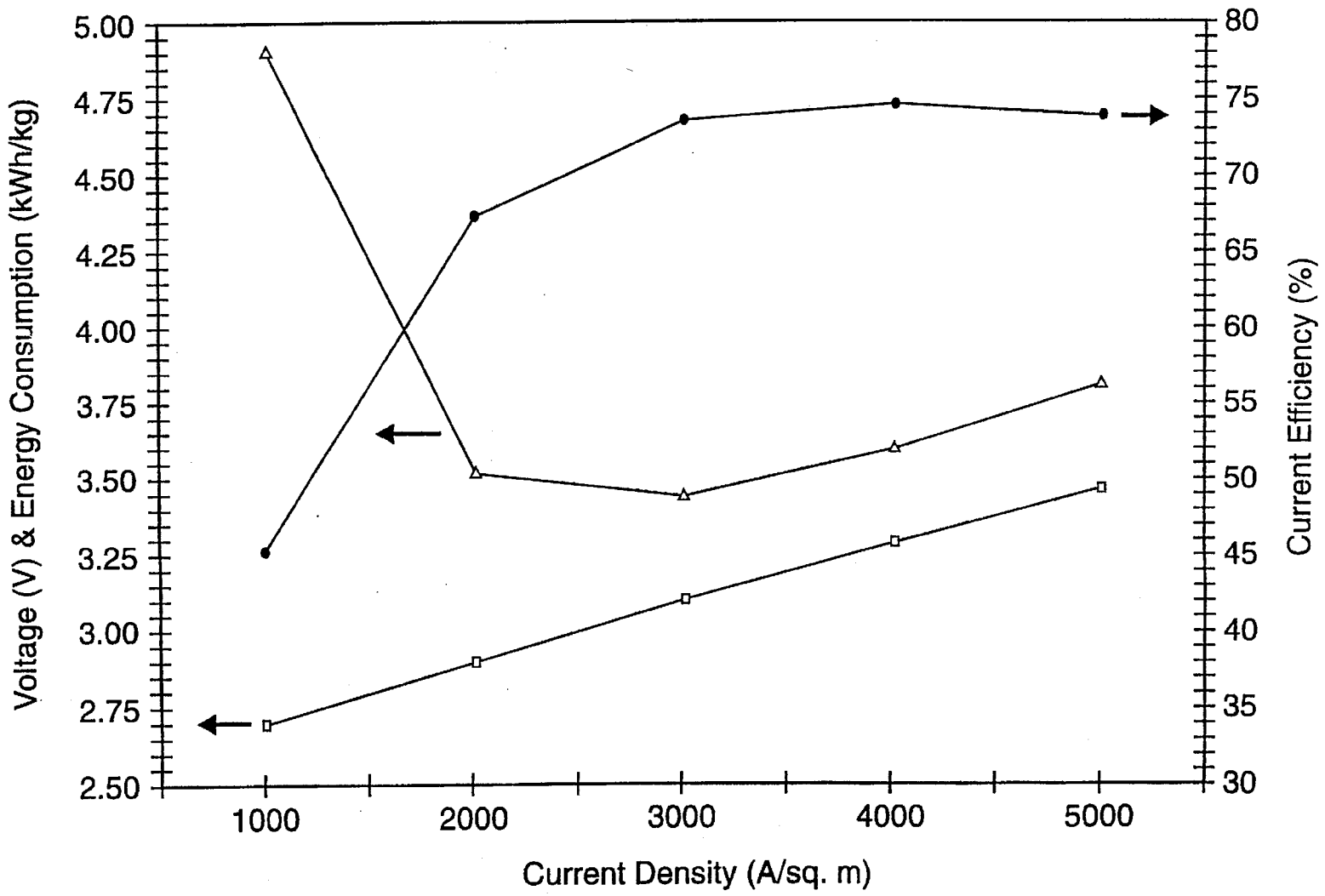
FIG. 8 is a plot of voltage, energy consumption and current efficiency vs. current density representing the end of the run from which the FIG. 7 data was taken.

Studies of voltage, energy and current efficiency as a function of current density were performed. The cell was initially charged with 425 g of cut zinc wire as above with diameter and length of 1.45 mm and a bed thickness of 1.1 cm, and with 70 g/L of zinc ion added as zinc sulfate, and 80 g/L of sulfuric acid. The cell temperature was maintained at 35° C., and current densities of 1,000, 2000, 3,000, 4,000 and 5,000 A/m$^2$ were used. Measurements of cell voltage, energy consumption and current efficiency (in the units given above) were taken at each current density, and the results are plotted in FIG. 7, where the open triangles denote energy consumption (using the scale on the left vertical axis), the open squares denote cell voltage (using the scale on the left vertical axis), and the filled circles denote current efficiency (using the scale on the right vertical axis). After 44 ampere-hours of current had passed through the cell, the tests were repeated, and the results are shown in FIG. 8, using the same notations as FIG. 7.

Optimal conditions are those with a maximal current efficiency and minimal energy consumption and cell voltage. At the beginning of the run as represented by FIG. 7, optimal conditions were between about 2,000 and about 3,000 A/m$^2$. Toward the end of the run (after the passage of 44 ampere-hours through the cell as represented by FIG. 8), optimal conditions were between about 3,000 and about 4,000 A/m$^2$. The passage of 44 ampere-hours through the cell is sufficient to greatly decrease the zinc content and increase the acid content of the catholyte. This is the cause of the significant difference between FIGS. 8 and 7.

EXAMPLE 6

In a further experiment, a series of runs was conducted in a cell similar to that of the preceding examples, using a bed thickness of 2.2 cm, zinc particles 1.45 mm in diameter, a starting catholyte containing 80 g/L dissolved zinc and 80 g/L sulfuric acid, and 10 mg/L of glue, and an anolyte containing 167 g/L of acid, in a cell with a DARAMIC membrane 0.45 mm in thickness and 0.01 m$^2$ in projected surface area, at a current density of 4,000 A/m$^2$. The runs were conducted at a temperature of 40° C.

Three runs were conducted, and in each case measurements of the current efficiency, voltage and power consumption were taken at the end of one hour of deposition. The results are shown in Table III below, in which the power consumption is expressed in kilowatt-hours per metric ton (1,000 g) of zinc deposited.

TABLE III

| Test Results After 1 Hour of Cell Operation | | | |
|---|---|---|---|
| Run No. | Current Efficiency (%) | Voltage (V) | Power Consumption (kWh/t) |
| 1 | 90.0 | 3.01 | 2,644 |
| 2 | 95.0 | 2.94 | 2,537 |
| 3 | 91.3 | 2.96 | 2,662 |

The foregoing is offered primarily for purposes of illustration. It will be readily apparent to those skilled in the art that the operating conditions, materials, procedural steps and other parameters of the system and method described herein may be further modified or substituted in various ways without departing from the spirit and scope of the invention.

We claim:

1. A method for electrodepositing zinc onto particles in an electrolytic cell from an electrolyte solution containing zinc ion, said electrolytic cell containing a current feeder and a counter electrode with an ion-permeable diaphragm interposed therebetween to define a gap of preselected width between said current feeder and said diaphragm, said method comprising passing a mixture of said particles and said electrolyte solution through said gap while passing a current across said gap, subject to the following limitations:

(a) for electrolytes containing acid at a concentration of $1.2\times10^{-2}$N or less, a number mean particle diameter ranging from a minimum of 0.3 mm to a maximum of 0.25 times said gap width, and (i) for a gap width of 20 mm or less, a maximum superficial current density equal to 22,000 minus the product of 800 times the gap width; and (ii) for a gap width greater than 20 mm, a maximum superficial current density of 6,000; and (b) for electrolytes containing acid at a concentration of from $1.2\times10^{-2}$N to 4.0N, a number mean particle diameter ranging from a minimum of 0.5 mm to a maximum of 0.25 times said gap width, and (i) for a gap width of 20 mm or less, a minimum superficial current density of 80 times the gap width, and a maximum current density equal to 22,000 minus the product of 800 times the gap width; and (ii) for a gap width greater than 20 mm, a minimum superficial current density of 1,600 and a maximum current density of 6,000;

wherein the gap width is expressed in millimeters, and the superficial current density is defined as the current divided by the projected surface area of the largest of said current feeder and said counter electrode and is expressed in amperes per square meter.

2. A method in accordance with claim 1 in which said gap width is at least 5 mm.

3. A method in accordance with claim 1 in which said gap width is at least 10 mm.

4. A method in accordance with claim 1 in which said gap width is between 5 mm and 25 mm.

5. A method in accordance with claim 1 in which said gap width is between 10 mm and 15 mm.

6. A method in accordance with claim 1 in which said gap width is at least about 5 mm, and under both limitations (a) and (b) for a gap width of 20 mm or less, said maximum superficial current density is equal to 14,000 minus the product of 400 times the gap width.

7. A method in accordance with claim 1 in which said gap width is from 5 mm to 25 mm, and under both limitations (a) and (b) said superficial current density ranges from 2,000 to 4,000.

8. A method in accordance with claim 1 in which said particles have a number mean diameter of from 0.35 mm to 2.25 mm.

9. A method in accordance with claim 1 in which said particles have a number mean diameter of from 1.0 mm to 1.5 mm.

10. A method in accordance with claim 1 having a ratio of particle number mean diameter to gap width of from 0.035 to 0.2.

11. A method in accordance with claim 1 having a ratio of particle number mean diameter to gap width of from 0.067 to 0.2.

12. A method in accordance with claim 1 in which said aqueous electrolyte solution is a solution of zinc sulfate.

13. A method in accordance with claim 1 in which said current is achieved by application of a voltage of 1.0 to 5.0 volts.

14. A method m accordance with claim 1 in which said current is achieved by application of a voltage of 2.5 to 4.0 volts.

15. A method m accordance with claim 1 in which said current is achieved by application of a voltage of 3.0 to 3.5 volts.

16. A method in accordance with claim 1 in which said current feeder and said counter electrode are vertically arranged, parallel flat plates, and said method comprises levitating said particles in one or more levitation regions by an upward stream of said electrolyte solution and permitting particles thus levitated to settle in one or more settling regions between said plates adjacent to said levitation regions.

17. A method in accordance with claim 1 in which said gap is divided into anolyte and catholyte compartments by a neutral, non-ionized barrier capable of passing dissolved ions but not said particles, and said particles are retained in said catholyte compartment.

18. A method in accordance with claim 17 in which said barrier is adjacent to the surface of said counter electrode.

19. A method in accordance with claim 1 in which said electrolyte solution contains a polarizing organic additive selected from the group consisting of gelatin, animal glue and gum arabic.

20. A method in accordance with claim 19 in which said polarizing organic additive is included at a concentration of 1 to 50 parts per million by weight of said electrolyte solution.

* * * * *